US007655605B2

(12) United States Patent
Rosenbaum et al.

(10) Patent No.: US 7,655,605 B2
(45) **Date of Patent: *Feb. 2, 2010**

(54) PROCESSES FOR PRODUCING EXTRA LIGHT HYDROCARBON LIQUIDS

(75) Inventors: John M. Rosenbaum, Richmond, CA (US); Brent K. Lok, San Francisco, CA (US); Joseph M. Pudlak, Vallejo, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 719 days.

This patent is subject to a terminal disclaimer.

(21) Appl. No.: 11/353,035

(22) Filed: Feb. 14, 2006

(65) Prior Publication Data

US 2006/0205610 A1 Sep. 14, 2006

Related U.S. Application Data

(60) Provisional application No. 60/660,464, filed on Mar. 11, 2005.

(51) Int. Cl.
*C10M 139/00* (2006.01)
*C10G 71/00* (2006.01)

(52) U.S. Cl. ..... 508/190; 208/18; 208/19

(58) Field of Classification Search ..... 508/190; 208/18–19

See application file for complete search history.

(56) References Cited

U.S. PATENT DOCUMENTS

| | | | |
|---|---|---|---|
| 3,773,650 | A | 11/1973 | Hislop et al. |
| 3,775,288 | A | 11/1973 | Eagen et al. |
| 3,852,207 | A | 12/1974 | Stangeland et al. |
| 3,904,513 | A | 9/1975 | Fischer et al. |
| 4,157,294 | A | 6/1979 | Iwao et al. |
| 4,347,121 | A | 8/1982 | Mayer et al. |
| 4,440,871 | A | 4/1984 | Lok et al. |
| 4,477,333 | A | 10/1984 | Hafez |
| 4,568,663 | A | 2/1986 | Mauldin |
| 4,673,487 | A | 6/1987 | Miller |
| 4,810,357 | A | 3/1989 | Chester et al. |
| 4,943,424 | A | 7/1990 | Miller |
| 5,135,638 | A | 8/1992 | Miller |
| 5,158,665 | A | 10/1992 | Miller |
| 5,282,958 | A | 2/1994 | Santilli et al. |
| 6,017,859 | A | 1/2000 | Rossi et al. |
| 6,096,691 | A | 8/2000 | Conary et al. |
| 6,235,688 | B1 | 5/2001 | Small et al. |
| 6,271,184 | B1 | 8/2001 | Seebauer et al. |
| 6,544,935 | B1 | 4/2003 | Vargo et al. |
| 6,689,723 | B2 | 2/2004 | Sullivan et al. |
| 6,703,353 | B1 | 3/2004 | Lok et al. |
| 7,018,962 | B2 | 3/2006 | Bloch et al. |
| 2004/0094453 | A1 | 5/2004 | Lok et al. |
| 2004/0178118 | A1 | 9/2004 | Rosenbaum et al. |
| 2005/0133407 | A1 | 6/2005 | Abernathy et al. |
| 2005/0133408 | A1 | 6/2005 | Abernathy et al. |
| 2005/0133409 | A1 | 6/2005 | Abernathy et al. |

FOREIGN PATENT DOCUMENTS

| | | | |
|---|---|---|---|
| EP | 0 609 079 | A1 | 1/1994 |
| EP | 0 776 959 | A | 6/1997 |
| EP | 0 668 342 | B1 | 8/1999 |
| EP | 1 452 579 | A1 | 9/2004 |
| WO | 99/20720 | A1 | 4/1999 |
| WO | 99/41332 | A1 | 8/1999 |
| WO | 99/41335 | A1 | 8/1999 |
| WO | 00/14179 | A1 | 3/2000 |
| WO | 00/14183 | A1 | 3/2000 |
| WO | 00/14187 | A2 | 3/2000 |
| WO | 00/14188 | A2 | 3/2000 |
| WO | 02/064710 | A2 | 8/2002 |
| WO | 02/070627 | A1 | 9/2002 |
| WO | 02/070629 | A1 | 9/2002 |
| WO | 02/070631 | A2 | 9/2002 |

OTHER PUBLICATIONS

ILSAC GF-4 Standard for Passenger Car Engine Oils , International Lubricant Standarization and Approval Committee, Japan Automobile Manufacturers Association, DaimlerChrysler Corporation, Ford Motor Company and General Motors Corporation, (2004).

Anderson, et al., "Reactions on ZSM-5-Type ZeoliteCatalyst", *J. of Catalysis* 58:114-130 (1979).

Baerlocher, Ch., Meier, W.M., and Olson, D.H., *Atlas of Zeolite Framework Types*, Fifth Revised Edition, Elsevier, pp. 10-15 (2001).

Barrer, R.M., *Zeolites, Science and Technology*, F.R. Rodrigues, L.D. Rollman and C. Naccache, editors, *NATO ASI Series* p. 75 (1984).

(Continued)

*Primary Examiner*—Walter D Griffin
*Assistant Examiner*—Frank C Campanell
(74) *Attorney, Agent, or Firm*—Crowell & Moring LLP

(57) ABSTRACT

The present invention relates to an extra light hydrocarbon liquid derived from highly paraffinic wax. This extra light hydrocarbon liquid is suitable for use as a lubricant additive diluent oil in oil soluble additive concentrates. This extra light hydrocarbon liquid derived from highly paraffinic wax has a viscosity of between about 1.0 and 3.5 cSt at 100° C. and a Noack volatility of less than 50 weight % and comprises greater than 3 weight % molecules with cycloparaffinic functionality and less than 0.30 weight percent aromatics. The extra light hydrocarbon liquid makes an excellent lubricant additive diluent oil because it has low volatility, low viscosity, good additive solubility, and excellent solubility in lubricant base oil stocks. The present invention also relates to finished lubricants comprising the oil soluble additive concentrates made with the extra light hydrocarbon liquid and finished lubricants comprising the oil soluble additive concentrates. The present invention further relates to processes for making these lubricant additive diluent oils, oil soluble additive concentrates, and finished lubricants.

32 Claims, No Drawings

OTHER PUBLICATIONS

Gatto, V.J., et al., "The Influence of Chemical Structure on the Physical Properties and Antioxidant Response of Hydrocracked Base Stocks and Polyalphaolefins", *J. Synthetic Lubrication* 19(1):3-18 (2002).

*Chemical Technology of Petroleum*, 3rd Edition, William Gruse and Donald Stevens, McGraw-Hill Book Company, Inc. New York, pp. 566-570 (1960).

Henderson, H. Ernest, "The North American Basestock Revolution", *Lubricants World*, Sep./Oct. 2004 pp. 12-15.

Kramer, D.C., et al., "Influence of Group II & III Base Oil Composition on VI and Oxidation Stability," presented at the 1999 AlChE Spring National Meeting in Houston, Mar. 16, 1999.

U.S. Appl. No. 11/353,205 "Extra Light Hydrocarbon Liquids", Rosenbaum et al., filed Feb. 14, 2006.

PROCESSES FOR PRODUCING EXTRA LIGHT HYDROCARBON LIQUIDS

This application claims priority to U.S. Provisional Application Ser. No. 60/660,464, filed Mar. 11, 2005, which is incorporated herein by reference in its entirety.

FIELD OF THE INVENTION

The present invention relates to a lubricant additive diluent oils derived from highly paraffinic wax and oil soluble additive concentrates comprising this lubricant additive diluent oil. The present invention also relates to finished lubricants comprising the oil soluble additive concentrates. The present invention further relates to processes for making these lubricant additive diluent oils, oil soluble additive concentrates, and finished lubricants.

BACKGROUND OF THE INVENTION

Lubricant additives, especially automotive additives such as viscosity index improvers and detergent-inhibitor (DI) packages require lubricant additive diluent oils to make them useable. Accordingly, lubricant additive diluent oils are used to dissolve lubricant additives to provide oil soluble additive concentrates. These oil soluble additive concentrates make the additives easier to transport, handle, and ultimately blend into lubricant base oils to provide a finished lubricant. The oil soluble additive concentrates are not useable or suitable as finished lubricants on their own. Rather, the oil soluble additive concentrates are blended with lubricant base oil stocks to provide a finished lubricant. It is desired that the lubricant additive diluent oils readily solubilize the lubricant additive and provide an oil additive concentrate that is readily soluble in the lubricant base oil stocks. In addition, it is desired that the lubricant additive diluent oils not introduce any undesirable characteristics, including, for example, high volatility, high viscosity, and impurities such as heteroatoms, to the lubricant base oil stocks and thus, ultimately to the finished lubricant.

Different lubricant additive diluent oils require differing amounts of lubricant additive diluent oil to provide a suitable oil soluble additive concentrate. By way of example, oil soluble additive concentrates comprising gear oil additive packages may contain as little as 25% weight lubricant additive diluent oil. Oil soluble additive concentrates comprising DI packages typically contain about 50% weight lubricant additive diluent oil. Oil soluble additive concentrates comprising viscosity index improver typically contain about 90% weight or more lubricant additive diluent oil.

Currently, the lubricant additive diluent oils used with most DI packages and viscosity index improvers are highly aromatic base oils that fall into API Group I. API Group I base oils, with their high solvency and good availability, have been preferred as lubricant additive diluent oils. However, these Group I oils have only average to poor low temperature performance, and they are much more susceptible to oxidation than modern oils, which are more highly saturated. In addition, Group I base oils have lower viscosity indexes (VI) and higher volatility than other base oils. Moreover, Group I base oils have high sulfur concentrations. Lubricant additive diluent oils can comprise up to 5 to 10 weight percent of a finished lubricant. Accordingly, the properties of the lubricant additive diluent oils are important as undesirable properties in the lubricant additive diluent oils can negatively impact the properties of the finished lubricant. Although more desirable in terms of their properties for the finished lubricant, conventional API Group II, conventional Group III, and Group IV base oils are difficult to use as lubricant additive diluent oils due to their poor ability to solubilize additives. Therefore, these base oils are not practical as lubricant additive diluent oils.

When added to lubricant base oil stocks, typical oil soluble additive, concentrates comprising DI packages or viscosity index improvers, tend to thicken the finished lubricant formulation and impair its low-temperature performance. Low viscosity lubricant additive diluent oils, which have been used in the past in an attempt to avoid thickening the finished lubricant, have either had high volatility or poor additive solubility, making them unsuitable for most applications. When added to engine oils, the typical oil soluble additive concentrates tend to adversely impact the cold-cranking simulator (CCS) viscosity and Mini-Rotary Viscometer (MRV). When added to automatic transmission fluid and gear oils, the typical oil soluble additive concentrates tend to adversely impact the Brookfield Viscosity at low temperature.

Accordingly, lubricant additive diluent oils with low viscosity, low volatility, and low concentrations of impurities, such as sulfur-containing compounds, are desired. Typical lubricant base oils with low volatilities also have high viscosities rendering them unsuitable for most applications, and typical lubricant base oils with low viscosities also have low volatilities and poor additive solubility rendering them unsuitable for most applications.

Engine manufacturers worldwide are introducing chemical limits on engine oils and additives that they believe will provide the safe margins for operation that their exhaust after-treatment hardware requires. These requirements will directly impact what is suitable for use as additives, lubricant base oils stocks, and lubricant additive diluent oils. Low sulfur and phosphorus limits on engine oils are being proposed. At a limit of about 0.3 weight % sulfur, zinc dithiodiphosphate antiwear additives need to be partially replaced with more costly additives, and reduced sulfur detergents and base oils are needed to provide formulation flexibility. As limits move toward 0.2 weight % sulfur, reduced or zero-sulfur lubricant base oils and diluent oils become essential to meet formulation targets. International Lubricants Standardization and Approval Committee (ILSAC) GF-4 passenger car engine oils, API PC-10 heavy duty engine oil, and other high quality finished lubricant specifications call for low sulfur formulations.

The ILSAC/Oil Committee adopted the new GF-4 specification for passenger car motor oils on Jan. 8, 2004, with a recommended start date for introducing GF-4 into the marketplace of Jul. 1, 2004. A new bench test requirement for engine oils meeting the GF-4 specification are maximum sulfur content by ASTM D 1552. As such, a 10 W oil may have a maximum of 0.7 weight % sulfur, while 0 W, and 5 W oils may have a maximum of 0.5 weight % sulfur. In addition, the oils meeting the GF-4 specification must have a Noack volatility by ASTM D 5800 of less than 15 weight % after one hour at 250° C., and a simulated distillation by ASTM D 6417 with a maximum of 10% at 371° C. API PC-10 is a proposed specification for heavy duty diesel engine oil and is expected to be approved in 2006 or 2007. It is expected that PC-10 oils will also have reduced limits for sulfur, similar to those amounts called for GF-4 passenger car motor oils.

Accordingly, lubricant additive diluent oils with low sulfur, excellent additive solubility, good elastomer compatibility, low volatility, low viscosity, high oxidation stability, good low temperature properties, and excellent solubility in the lubricant base oils are desired.

SUMMARY OF THE INVENTION

The present invention relates to extra light hydrocarbon liquids derived from highly paraffinic wax. These extra light hydrocarbon liquids derived from highly paraffinic wax may be used as lubricant additive diluent oils. Accordingly, the present invention relates to lubricant additive diluent oils derived from highly paraffinic wax and oil soluble additive concentrates comprising this lubricant additive diluent oil. The present invention also relates to finished lubricants comprising the oil soluble additive concentrates. The present invention further relates to processes for making these extra light hydrocarbon liquids derived from highly paraffinic wax, the lubricant additive diluent oils, the oil soluble additive concentrates, and the finished lubricants.

DETAILED DESCRIPTION OF THE INVENTION

Finished lubricants comprise at least one lubricant base oil and at least one additive. Typically, the at least one additive is added to the lubricant base oil in the form of an oil soluble additive concentrate comprising at least one additive and a lubricant additive diluent oil, to improve the additive's solubility in the lubricant base oil. For lubricant additive diluent oils, it is important that the oil be heavy enough not to contribute volatility to the finished lubricant, but not be so heavy that the oil thickens the finished lubricant.

It has been surprisingly discovered that certain lubricant base oils derived from highly paraffinic wax make excellent lubricant additive diluent oils. Examples of suitable highly paraffinic waxes include Fischer-Tropsch derived wax, slack wax, deoiled slack wax, and refined foots oils, waxy lubricant raffinates, n-paraffin waxes, normal alpha olefin (NAO) waxes, waxes produced in chemical plant processes, deoiled petroleum derived waxes, microcrystalline waxes, and mixtures thereof. These highly paraffinic waxes are processed to provide lubricant base oil fractions having unexpectedly low volatility and low viscosity and unexpectedly also having good additive solubility. In one preferred embodiment, the highly paraffinic wax is a Fischer-Tropsch derived wax and provides a Fischer-Tropsch derived lubricant base oil fraction.

Accordingly, it has been surprisingly discovered that lubricant base oils derived from highly paraffinic wax can advantageously be used as lubricant additive diluent oils, wherein the lubricant base oil comprises greater than 3 weight % molecules with cycloparaffinic funtionality and less than 0.30 weight percent aromatics and have kinematic viscosities between about 1.0 cSt and 3.5 cSt at 100° C. and a Noack volatility less than a Noack Volatility Factor as calculated by the following equation:

$$\text{Noack Volatility Factor} = 160 - 40(\text{Kinematic Viscosity at } 100^\circ\text{ C.}).$$

Preferably, the lubricant base oil fraction derived from highly paraffinic wax has a viscosity of between about 2.0 and 3.5 cSt at 100° C. and more preferably between about 2.0 and 3.0 cSt at 100° C. Preferably, the lubricant base oil fraction derived from highly paraffinic wax has a Noack volatility of less than 50 weight %. The lubricant base oil fractions derived from highly paraffinic wax according to the present invention have unexpectedly low Noack volatilities given their relatively low kinematic viscosities.

The lubricant base oils of the present invention may also have preferred alkyl branching placements. As such, the lubricant base oils of the present invention may comprise predominantly methyl branching. The branching may be such that there are 6 to 18 alkyl branches per 100 carbon; greater than 25% of the branches are 5 or more carbon atoms apart from each other; and less than 40% of the branches are within 2 to 3 carbon atoms apart from each other.

These lubricant base oils derived from highly paraffinic wax can be used in applications requiring low volatility, low viscosity, exceptional low-temperature performance, and good additive solubility. In addition, these lubricant base oils derived from highly paraffinic wax exhibit excellent oxidation resistance and good elastomer compatibility. Advantageously, the lubricant base oil fractions derived from highly paraffinic wax can be used as additive diluent oils in applications requiring low volatility, such as ILSAC GF-4 and API PC-10 engine oils.

The lubricant base oil fractions derived from highly paraffinic wax of the present invention are prepared from the highly paraffinic wax by a process including hydroisomerization. Preferably, the highly paraffinic wax is hydroisomerized using a shape selective intermediate pore size molecular sieve comprising a noble metal hydrogenation component under conditions of about 600° F. to 750° F.

In one preferred embodiment, the highly paraffinic wax is a Fischer-Tropsch derived wax and provides a Fischer-Tropsch derived lubricant base oil fraction. The lubricant base oil fractions are prepared from the waxy fractions of Fischer-Tropsch syncrude. As such, the Fischer-Tropsch derived lubricant base oil fractions used in the oil soluble additive concentrates are made by a process comprising performing a Fischer-Tropsch synthesis to provide a product stream; isolating from the product stream a substantially paraffinic wax feed; hydroisomerizing the substantially paraffinic wax feed; isolating an isomerized oil; and optionally hydrofinishing the isomerized oil. From the process, a Fischer-Tropsch derived lubricant base oil fraction comprising less than 0.30 weight % aromatics and greater than 3 weight % molecules with cycloparaffinic functionality and having kinematic viscosity between about 1.0 cSt and 3.5 cSt at 100° C. and a Noack volatility less than the Noack Volatility Factor is isolated. The herein-recited preferred embodiments of the Fischer-Tropsch lubricant base oil also may be isolated from the process. Preferably, the paraffinic wax feed is hydroisomerized using a shape selective intermediate pore size molecular sieve comprising a noble metal hydrogenation component under conditions of about 600° F. to 750° F. Preferred processes for making the Fischer-Tropsch derived lubricant base oils are described in U.S. Ser. No. 10/744,870, filed Dec. 23, 2003, herein incorporated by reference in its entirety. Examples of embodiments of Fischer-Tropsch lubricant base oil fractions with high monocycloparaffins and low multicycloparaffins are described in U.S. Ser. No. 10/744,389, filed Dec. 23, 2003, herein incorporated by reference in its entirety.

According to the present invention, the lubricant base oil fractions derived from highly paraffinic wax contain a relatively high weight percent of molecules with cycloparaffinic functionality. In a preferred embodiment, the lubricant base oil fraction derived from highly paraffinic wax comprises greater than 5 weight percent molecules with cycloparaffinic functionality. In another preferred embodiment, the lubricant base oil fraction derived from highly paraffinic wax comprises a ratio of weight percent of molecules with monocycloparaffinic functionality to weight percent of molecules with multicycloparaffinic functionality of greater than 5. The lubricant base oil fraction derived from highly paraffinic wax containing a high ratio of weight percent of molecules with monocycloparaffinic functionality to weight percent of molecules with multicycloparaffinic functionality (or high weight percent of molecules with monocycloparaffinic functionality and low weight percent of molecules with multicycloparaffinic functionality) are exceptional lubricant additive diluent oils and make exceptional oil soluble additive concentrates.

Even though these lubricant base oil fractions derived from highly paraffinic wax contain a high paraffins content, they unexpectedly exhibit solubility for additives, including VI improvers and lubricant additive packages, because cycloparaffins impart additive solubility. These lubricant base oil fractions derived from highly paraffinic wax are also desirable because molecules with multicycloparaffinic functionality reduce oxidation stability, lower viscosity index, and increase Noack volatility. Models of the effects of molecules with multicycloparaffinic functionality are given in V. J. Gatto, et al, "The Influence of Chemical Structure on the Physical Properties and Antioxidant Response of Hydrocracked Base Stocks and Polyalphaolefins," J. Synthetic Lubrication 19-1, April 2002, pp 3-18. In addition, the lubricant base oil fractions of the present invention exhibit unexpectedly low volatility and relatively low viscosity.

Accordingly, in a preferred embodiment, the lubricant base oil fractions derived from highly paraffinic wax used as lubricant additive diluent oils in oil soluble additive concentrates comprise very low weight percents of molecules with aromatic functionality, a high weight percent of molecules with cycloparaffinic functionality, and a high ratio of weight percent of molecules with monocycloparaffinic functionality to weight percent of molecules with multicycloparaffinic functionality (or high weight percent of molecules with monocycloparaffinic functionality and very low weight percents of molecules with multicycloparaffinic functionality). The lubricant base oils of the present invention may also have preferred alkyl branching placements.

The lubricant base oil fractions derived from highly paraffinic wax used as lubricant additive diluent oils in oil soluble additive concentrates contain greater than 95 weight % saturates as determined by elution column chromatography, ASTM D 2549-02. Olefins are present in an amount less than detectable by long duration $C^{13}$ Nuclear Magnetic Resonance Spectroscopy (NMR). Preferably, molecules with aromatic functionality are present in amounts less than 0.3 weight percent by HPLC-UV, and confirmed by ASTM D 5292-99 modified to measure low level aromatics. In preferred embodiments molecules with aromatic functionality are present in amounts less than 0.10 weight percent, preferably less than 0.05 weight percent, more preferably less than 0.01 weight percent. Sulfur is present in amounts less than 25 ppmw, preferably less than 5 ppmw, and more preferably less than 1 ppmw, as determined by ultraviolet fluorescence by ASTM D 5453-00.

According to the present invention, the lubricant base oil fractions derived from highly paraffinic wax are advantageously used as lubricant additive diluent oils in oil soluble additive concentrates. The oil soluble additive concentrates according to the present invention comprise 5 to 98 weight % of the lubricant base oil fraction derived from highly paraffinic wax and at least 2 weight % of one or more lubricant additives, wherein the lubricant base oil fraction comprises greater than 3 weight % molecules with cycloparaffinic functionality and less than 0.30 weight percent aromatics and has a viscosity of between about 1.0 and 3.5 cSt at 100° C. and a Noack volatility less than the Noack Volatility Factor. The lubricant base oil fraction derived from highly paraffinic wax readily solubilizes the lubricant additives and provides an oil additive concentrate that is readily soluble in the lubricant base oil stocks. In addition, the lubricant base oil fraction derived from highly paraffinic wax does not introduce any undesirable characteristics, including, for example, high volatility, high viscosity, and impurities such as heteroatoms, to the lubricant base oil stocks and thus, ultimately to the finished lubricant. The finished lubricant according to the present invention comprises the oil soluble additive concentrate and one or more lubricant base oils. The finished lubricant may optionally comprise one or more additional additives and other oil soluble additive concentrates.

Definitions and Terms

The following terms will be used throughout the specification and will have the following meanings unless otherwise indicated.

"API CI-4" is a specification of the current engine oil service category of heavy duty engine oils.

"API PC-10" is a specification of the proposed new engine oil service category of heavy duty engine oils. It is expected that PC-10 oils will also have reduced limits for sulfur, in similar amounts as for GF-4 automotive gasoline engine oils.

"ILSAC GF-3" is a specification of an engine oil service category of automotive gasoline engines, which became official on Jul. 1, 2001.

"ILSAC GF-4" is a specification of a new engine oil service category of automotive gasoline engines, which was approved on Jan. 8, 2004 and became official on Jul. 1, 2004. This category introduces new sulfur limits by ASTM D 1552. The maximum sulfur limit for 0 W and 5 W oils is 0.5 weight percent, while the maximum sulfur limit for 10 W oils is 0.7 weight percent.

"SAE J300 multigrade engine oils" are engine oils defined by the Engine Oil Viscosity Classifications for multigrade engine oils in SAE J300, revised June 2001. The multigrade viscosity types are 0 W-XX, 5 W-XX, 15 W-XX, 20 W-XX, and 25W-XX, with XX being 20, 30, 40, 50, or 60. Specific limits are defined for maximum low temperature cranking viscosity by ASTM D 5293, maximum low temperature pumping viscosity with no yield stress by ASTM D 4684, minimum and maximum low shear rate kinematic viscosity at 100° C. by ASTM D 445, and minimum high temperature high shear rate viscosity by ASTM D 4683 or ASTM D 5481.

The term "derived from a Fischer-Tropsch process" or "Fischer-Tropsch derived," means that the product, fraction, or feed originates from or is produced at some stage by a Fischer-Tropsch process.

The term "derived from a petroleum" or "petroleum derived" means that the product, fraction, or feed originates from the vapor overhead streams from distilling petroleum crude and the residual fuels that are the non-vaporizable remaining portion. A source of the petroleum derived can be from a gas field condensate.

Highly paraffinic wax means a wax having a high content of n-paraffins, generally greater than 40 weight %, preferably greater than 50 weight %, and more preferably greater than 75 weight %. Preferably, the highly paraffinic waxes used in the present invention also have very low levels of nitrogen and sulfur, generally less than 25 ppm total combined nitrogen and sulfur and preferably less than 20 ppm. Examples of highly paraffinic waxes that may be used in the present invention include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. The pour points of the highly paraffinic waxes useful in this invention are greater than 50° C. and preferably greater than 60° C.

The term "derived from highly paraffinic wax" means that the product, fraction, or feed originates from or is produced at some stage by from a highly paraffinic wax.

Aromatics means any hydrocarbonaceous compounds that contain at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

Molecules with cycloparaffinic functionality mean any molecule that is, or contains as one or more substituents, a monocyclic or a fused multicyclic saturated hydrocarbon group. The cycloparaffinic group may be optionally substituted with one or more, preferably one to three, substituents. Representative examples include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more, preferably one to three, substituents. Representative examples include, but are not limited to, cyclopropyl, cyclobutyl, cyclohexyl, cyclopentyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more, preferably one to three, substituents. Representative examples include, but are not limited to, decahydronaphthalene, octahydropentalene, 3,7,10-tricyclohexylpentadecane, decahydro-1-(pentadecan-6-yl)naphthalene, and the like.

Brookfield Viscosity: ASTM D 2983-03 is used to determine the low-shear-rate viscosity of automotive fluid lubricants at low temperatures. The low-temperature, low-shear-rate viscosity of automatic transmission fluids, gear oils, torque and tractor fluids, and industrial and automotive hydraulic oils are frequently specified by Brookfield viscosities. The GM 2003 DEXRON® III automatic transmission fluid specification requires a maximum Brookfield viscosity at −40° C. of 20,000 cP. The Ford MERCON® V specification requires a Brookfield viscosity at −40° C. between 5,000 and 13,000 cP. The Automotive Gear Lubricant Viscosity Classification SAE J306 for 75 W gear lubricants has a low temperature viscosity specification such that the maximum temperature for a viscosity of 150,000 cP is −40° C. When added to automatic transmission fluid and gear oils, the oil soluble additive concentrates of the present invention do not adversely impact the Brookfield Viscosity at low temperature.

Automotive Gear Lubricant Viscosity Classifications - SAE J306

| SAE Viscosity Grade | Max Temperature for Viscosity of 150,000 cP (° C.) | Kinematic Viscosity at 100° C. (cSt) min | Max |
|---|---|---|---|
| 70 W | −55 | 4.1 | — |
| 75 W | −40 | 4.1 | — |
| 80 W | −26 | 7.0 | — |
| 85 W | −12 | 11.0 | — |
| 80 | — | 7.0 | <11.0 |
| 85 | — | 11.0 | <13.5 |
| 90 | — | 13.5 | <24.0 |
| 140 | — | 24.0 | <41.0 |
| 250 | — | 41.0 | — |

Kinematic viscosity is a measurement of the resistance to flow of a fluid under gravity. Many lubricant base oils, finished lubricants made from them, and the correct operation of equipment depends upon the appropriate viscosity of the fluid being used. Kinematic viscosity is determined by ASTM D 445-01. The results are reported in centistokes (cSt). The Fischer-Tropsch derived lubricant base oil fractions of the present invention have a kinematic viscosity of between about 1.0 cSt and 3.5 cSt at 100° C. Preferably, the lubricant base oil fractions derived from highly paraffinic wax have a kinematic viscosity of between about 2.0 cSt and 3.5 cSt at 100° C. and more preferably, the lubricant base oil fractions derived from highly paraffinic wax have a kinematic viscosity of between about 2.0 cSt and 3.0 cSt at 100° C.

Viscosity Index (VI) is an empirical, unitless number indicating the effect of temperature change on the kinematic viscosity of the oil. Liquids change viscosity with temperature, becoming less viscous when heated; the higher the VI of an oil, the lower its tendency to change viscosity with temperature. High VI lubricants are needed wherever relatively constant viscosity is required at widely varying temperatures. For example, in an automobile, engine oil must flow freely enough to permit cold starting, but must be viscous enough after warm-up to provide full lubrication. VI may be determined as described in ASTM D 2270-93. Preferably, the lubricant base oil fractions derived from highly paraffinic wax have a viscosity index of between about 105 and 155.

The "Viscosity Index Factor" of the lubricant base oil derived from highly paraffinic wax is an empirical number derived from kinematic viscosity of the lubricant base oil fraction. The viscosity index factor is calculated by the following equation:

$$\text{Viscosity Index Factor} = 28 \times \ln(\text{Kinematic Viscosity of the lubricant base oil fraction at } 100^\circ\text{ C.}) + 95$$

The lubricant base oil fractions derived from highly paraffinic wax may have a Viscosity Index greater than the Viscosity Index Factor.

Pour point is a measurement of the temperature at which a sample of lubricant base oil will begin to flow under carefully controlled conditions. Pour point may be determined as described in ASTM D 5950-02. The results are reported in degrees Celsius. Many commercial lubricant base oils have specifications for pour point. When lubricant base oils have low pour points, they also are likely to have other good low temperature properties, such as low cloud point, low cold filter plugging point, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95. Lubricant base oils having pour-cloud point spreads below about 35° C. are desirable. Higher pour-cloud point spreads require processing the lubricant base oil to very low pour points in order to meet cloud point specifications.

Noack volatility is defined as the mass of oil, expressed in weight %, which is lost when the oil is heated at 250° C. and 20 mmHg (2.67 kPa; 26.7 mbar) below atmospheric in a test crucible through which a constant flow of air is drawn for 60 minutes, according to ASTM D5800. A more convenient method for calculating Noack volatility and one which correlates well with ASTM D5800 is by using a thermo gravimetric analyzer test (TGA) by ASTM D6375. TGA Noack volatility is used throughout this disclosure unless otherwise stated. Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. Preferably, the lubricant base oil fractions derived from highly paraffinic wax of the present invention have a Noack volatility of less than 50 weight %. More preferably, the lubricant base oil fractions derived from highly paraffinic wax of the present invention have a Noack volatility of less than 35 weight %.

The "Noack Volatility Factor" of the lubricant base oil derived from highly paraffinic wax is an empirical number derived from kinematic viscosity of the lubricant base oil fraction. The Noack volatility factor is calculated by the following equation:

$$\text{Noack Volatility Factor} = 160 - 40(\text{Kinematic Viscosity at } 100^\circ\text{ C.})$$

The lubricant base oil fractions derived from highly paraffinic wax have a Noack volatility less than the Noack Volatility Factor.

The aniline point test indicates if an oil is likely to damage elastomers (rubber compounds) that come in contact with the oil. The aniline point is called the "aniline point temperature," which is the lowest temperature (° F. or ° C.) at which equal volumes of aniline ($C_6H_5NH_2$) and the oil form a single phase. The aniline point (AP) correlates roughly with the amount and type of aromatic hydrocarbons in an oil sample. A low AP is indicative of higher aromatics, while a high AP is indicative of lower aromatics content. The aniline point is determined by ASTM D611-04. Preferably, the lubricant base oil fractions derived from highly paraffinic wax of the present invention have an aniline point greater than 36×ln(Kinematic Viscosity of the lubricant base oil fraction at 100° C.)+200. Accordingly, the lubricant base oil fractions derived from highly paraffinic wax exhibit good elastomer compatibility.

The Oxidator BN with L-4 Catalyst Test is a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., reporting the hours to absorption of 1000 ml of $O_2$ by 100 g of oil. In the Oxidator BN with L-4 Catalyst test, 0.8 ml of catalyst is used per 100 grams of oil. The catalyst is a mixture of soluble metal naphthenates in kerosene simulating the average metal analysis of used crankcase oil. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithiophosphate per 100 grams of oil, or approximately 1.1 grams of OLOA® 260. The Oxidator BN with L-4 Catalyst Test measures the response of a finished lubricant in a simulated application. High values, or long times to adsorb one liter of oxygen, indicate good stability. OLOA® is an acronym for Oronite Lubricating Oil Additive®, which is a registered trademark of Chevron-Texaco Oronite Company.

Generally, the Oxidator BN with L-4 Catalyst Test results should be above about 7 hours. Preferably, the Oxidator BN with L-4 value will be greater than about 10 hours. Preferably, the lubricant base oil fraction derived from highly paraffinic wax of the present invention have results greater than about 10 hours. The Fischer-Tropsch derived lubricant base oil fractions of the present invention have results much greater than 10 hours. Preferably, the Fischer-Tropsch derived lubricant base oil fractions of the oil soluble additive concentrates of the present invention have an Oxidator BN with L-4 Catalyst test result of greater than 25 hours.

Highly Paraffinic Wax

The highly paraffinic wax used in making the lubricant base oils of the present invention can be any wax having a high content of n-paraffins. Preferably, the highly paraffinic wax comprise greater than 40 weight % n-paraffins, preferably greater than 50 weight %, and more preferably greater than 75 weight %. Preferably, the highly paraffinic waxes used in the present invention also have very low levels of nitrogen and sulfur, generally less than 25 ppm total combined nitrogen and sulfur and preferably less than 20 ppm. Examples of highly paraffinic waxes that may be used in the present invention include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. The pour points of the highly paraffinic waxes useful in this invention are greater than 50° C. and preferably greater than 60° C.

It has been discovered that these highly paraffinic waxes can be processed to provide lubricant base oil fractions having low volatility and low viscosity and unexpectedly also having good additive solubility. In one preferred embodiment, the highly paraffinic wax is a Fischer-Tropsch derived wax and provides a Fischer-Tropsch derived lubricant base oil fraction.

Fischer-Tropsch Synthesis

In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guard-beds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, contacting a synthesis gas comprising a mixture of $H_2$ and CO with a Fischer-Tropsch catalyst under suitable temperature and pressure reactive conditions forms liquid and gaseous hydrocarbons. The Fischer-Tropsch reaction is typically conducted at temperatures of about 300-700° F. (149-371° C.), preferably about 400-550° F. (204-228° C.); pressures of about 10-600 psia, (0.7-41 bars), preferably about 30-300 psia, (2-21 bars); and catalyst space velocities of about 100-10,000 cc/g/hr, preferably about 300-3,000 cc/g/hr. Examples of conditions for performing Fischer-Tropsch type reactions are well known to those of skill in the art.

The products of the Fischer-Tropsch synthesis process may range from $C_1$ to $C_{200+}$ with a majority in the $C_5$ to $C_{100+}$ range. The reaction can be conducted in a variety of reactor types, such as fixed bed reactors containing one or more catalyst beds, slurry reactors, fluidized bed reactors, or a combination of different type reactors. Such reaction processes and reactors are well known and documented in the literature.

The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g., tail gases through middle distillate fuels), largely in the $C_5$-$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$.

Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that is used as a feedstock to the process for providing the Fischer-Tropsch derived lubricant base oil fraction used as a lubricant additive diluent oil in the oil soluble concentrates and finished lubricants according to the present invention.

The Fischer-Tropsch lubricant base oil fractions used as lubricant additive diluent oils in the oil soluble additive concentrates are prepared from the waxy fractions of the Fischer-Tropsch syncrude by a process including hydroisomerization. Preferably, the Fischer-Tropsch lubricant base oils are made by a process as described in U.S. Ser. No. 10/744,870, filed Dec. 23, 2003, herein incorporated by reference in its entirety. The Fischer-Tropsch lubricant base oil fractions used in the oil soluble additive concentrates according to the present invention may be manufactured at a site different from the site at which the components of the oil soluble additive concentrates are received and blended and at a site different from the site at which the oil soluble additive concentrate is blended with lubricant base oil stocks to provide a finished lubricant. The site at which the oil soluble additive concentrate is made may be the same or different than the site at which the finished lubricant is made.

Process for Providing Light Lubricant Base Oil Fraction

These light lubricant base oil fractions derived from highly paraffinic wax of the present invention are made by process comprising providing a highly paraffinic wax and then hydroisomerizing the highly paraffinic wax to provide the lubricant base oil fractions as described herein. Preferably, the highly paraffinic wax is hydroisomerized using a shape selective intermediate pore size molecular sieve comprising a noble metal hydrogenation component under conditions of about 600° F. to 750° F.

In one preferred embodiment, the highly paraffinic wax is a Fischer-Tropsch derived wax and provides a Fischer-Tropsch derived lubricant base oil fraction. The Fischer-Tropsch derived lubricant base oil fraction used in the oil soluble additive concentrate is made by a Fischer-Tropsch synthesis process followed by hydroisomerization of the waxy fractions of the Fischer-Tropsch syncrude.

Hydroisomerization

The highly paraffinic waxes are subjected to a process comprising hydroisomerization to provide the lubricant base oil fractions useful as lubricant additive diluent oils in oil soluble additive concentrates according to the present invention.

Hydroisomerization is intended to improve the cold flow properties of the lubricant base oil by the selective addition of branching into the molecular structure. Hydroisomerization ideally will achieve high conversion levels of the highly paraffinic wax to non-waxy isoparaffins while at the same time minimizing the conversion by cracking. Preferably, the conditions for hydroisomerization in the present invention are controlled such that the conversion of the compounds boiling above about 700° F. in the wax feed to compounds boiling below about 700° F. is maintained between about 10 wt % and 50 wt %, preferably between 15 wt % and 45 wt %.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10-(or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

A particularly preferred intermediate pore size molecular sieve, which is useful in the present process is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 to about 7.1 Å, and preferably in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 to 6.5 Angstrom with little hindrance.

Hydroisomerization catalysts useful in the present invention comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports, which are conventionally used for catalysts, including silica, alumina, silica-alumina, magnesia, titania and combinations thereof.

The conditions for hydroisomerization will be tailored to achieve a lubricant base oil fraction comprising less than about 0.3 weight % aromatics and greater than 3 weight % molecules with cycloparaffinic functionality. Preferably, the conditions provide a lubricant base oil fraction comprising greater than 5 weight % molecules with cycloparaffinic functionality and a ratio of weight percent of molecules with monocycloparaffinic functionality of weight percent of molecules with multicycloparaffinic functionality of greater than 5, more preferably greater than 15, and even more preferably greater than 50. The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 500° F. to about 775° F. (260° C. to about 413° C.), preferably 600° F. to about 750° F. (315° C. to about 399° C.), more preferably about 600° F. to about 700° F. (315° C. to about 371° C.); and pressures from about 15 to 3000 psig, preferably 100 to 2500 psig. The hydroisomerization pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr−1, preferably from about 0.1 to about 5 hr−1. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization are described in U.S. Pat. Nos. 5,282,958 and 5,135,638, the contents of which are incorporated by reference in their entirety.

Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone.

Hydrotreating

The highly paraffinic waxy feed to the hydroisomerization process may be hydrotreated prior to hydroisomerization. Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Catalysts used in carrying out hydrotreating operations are well known in the art. See, for example, U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300° F. to about 750° F. (about 150° C. to about 400° C.), preferably ranging from 450° F. to 725° F. (230° C. to 385° C.).

Hydrofinishing

Hydrofinishing is a hydrotreating process that may be used as a step following hydroisomerization to provide the lubricant base oil fractions derived from highly paraffinic wax. Hydrofinishing is intended to improve oxidation stability, UV stability, and appearance of the lubricant base oil fractions by removing traces of aromatics, olefins, color bodies, and solvents. As used in this disclosure, the term UV stability refers to the stability of the lubricant base oil fraction or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487.

The lubricant base oil fractions derived from highly paraffinic wax of the present invention may be hydrofinished to improve product quality and stability. During hydrofinishing, overall liquid hourly space velocity (LHSV) is about 0.25 to 2.0 $hr^{-1}$, preferably about 0.5 to 1.0 $hr^{-1}$. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Suitable hydrofinishing catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble metal (such as nickel-molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

Clay treating to remove impurities is an alternative final process step to provide lubricant base oil fractions derived from highly paraffinic wax.

Fractionation

Optionally, the process to provide the light lubricant base oil fractions derived from highly paraffinic wax may include fractionating the highly paraffinic wax feed prior to hydroisomerization, or fractionating of the lubricant base oil obtained from the hydroisomerization process. The fractionation of the highly paraffinic wax feed or the isomerized lubricant base oil into fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons may take place leading to fouling of the equipment and to lower yields of the heavier cuts. Vacuum distillation is typically used to separate the higher boiling material, such as the lubricant base oil fractions, into different boiling range cuts. Fractionating the lubricant base oil into different boiling range cuts enables the lubricant base oil manufacturing plant to produce more than one grade, or viscosity, of lubricant base oil.

Solvent Dewaxing

The process to make the lubricant base oil fractions derived from highly paraffinic wax may also include a solvent dewaxing step following the hydroisomerization process. Solvent dewaxing optionally may be used to remove small amounts of remaining waxy molecules from the lubricant base oil after hydroisomerization. Solvent dewaxing is done by dissolving the lubricant base oil in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. Solvent dewaxing is also described in U.S. Pat. Nos. 4,477,333, 3,773,650 and 3,775,288.

Lubricant Base Oil Fraction Derived from Highly Paraffinic Wax

The light lubricant base oil fraction derived from highly paraffinic wax according to the present invention is suitable for use as a lubricant additive diluent oil in oil soluble additive concentrates. The lubricant base oil fraction derived from highly paraffinic wax has a viscosity of between about 1.0 cSt and 3.5 cSt at 100° C., preferably between about 2 cSt and 3.5 cSt at 100° C., and more preferably between about 2 cSt and 3.0 cSt at 100° C. Given the relatively low kinematic viscosity, the lubricant base oil fraction derived from highly paraffinic wax advantageously has a high Noack volatility. The lubricant base oil fraction derived from highly paraffinic wax has a Noack volatility less than the Noack volatility factor as calculated by the following equation:

$$\text{Noack Volatility Factor}=160-40(\text{Kinematic Viscosity at } 100^\circ\text{ C.}).$$

Preferably, the lubricant base oil fraction derived from highly paraffinic wax has a Noack volatility of less than 50 weight % and preferably, less than 35 weight %. Accordingly, the lubricant base oil fractions derived from highly paraffinic wax of the present invention advantageously have both low viscosity and low volatility.

In certain preferred embodiments, the lubricant base oil fractions derived from highly paraffinic wax has a VI of between about 105 and 155.

Preferably, the Viscosity Index of the lubricant base oil fraction derived from highly paraffinic wax is greater than the Viscosity Index Factor as calculated by the following equation:

$$\text{Viscosity Index Factor}=28\times\ln(\text{Kinematic Viscosity of the Fischer-Tropsch derived base oil fraction at } 100^\circ\text{ C.})+95.$$

In other preferred embodiments, the lubricant base oil fractions derived from highly paraffinic wax comprise a weight % of molecules with cycloparaffinic functionality of greater than the kinematic viscosity at 100° C. multiplied by three.

The lubricant base oil fractions according to the present invention have good low volatilities so that they do not contribute volatility to the finished lubricant, while also being not so heavy as to thicken the finished lubricant. Accordingly, these lubricant base oil fractions have low volatility and low viscosity.

The lubricant base oil fractions according to the present invention comprise extremely low levels of unsaturates. The lubricant base oil fraction comprises less than 0.30 weight percent aromatics and greater than 3 weight % molecules with cycloparaffinic functionality. Preferably, the lubricant base oil fraction comprises a ratio of weight percent of molecules with monocycloparaffinic functionality to weight percent of molecules with multicycloparaffinic functionality of greater than 5.

In a preferred embodiment, the lubricant base oil fraction comprises greater than 5 weight percent molecules with cycloparaffinic functionality. In other preferred embodiments, the lubricant base oil fraction used in the oil soluble additive concentrates comprises a ratio of weight % of molecules with monocycloparaffinic functionality to weight % of molecules with multicycloparaffinic functionality of greater than 5, preferably greater than 15, and more preferably greater than 50. In another preferred embodiment, the lubricant base oil fraction comprises a ratio of weight percent of molecules with cycloparaffinic functionality of greater than the kinematic viscosity at 100° C. multiplied by three.

In preferred embodiments, the lubricant base oil fraction comprises greater than 9 alkyl branches/100 carbons. The lubricant base oil fraction used as lubricant additive diluent oils in the oil soluble additive concentrates may also have preferred alkyl branching placements. As such, the lubricant base oils of the present invention may comprise predominantly methyl branching. The branching may be such that there are 6 to 18 alkyl branches per 100 carbon; greater than 25% of the branches are 5 or more carbon atoms apart from each other; and less than 40% of the branches are within 2 to 3 carbon atoms apart from each other.

These lubricant base oil fractions containing cycloparaffins exhibit unexpectedly good solubility for additives, including VI improvers and lubricant additive packages, because cycloparaffins impart additive solubility. The lubricant base oil fraction containing a high ratio of weight percent of molecules with monocycloparaffinic functionality to weight percent of molecules with multicycloparaffinic functionality (or high weight percent of molecules with monocycloparaffinic functionality and low weight percent of molecules with multicycloparaffinic functionality) are also desirable because molecules with multicycloparaffinic functionality reduce oxidation stability, lower viscosity index, and increase Noack volatility. Accordingly, the lubricant base oil fractions according to the present invention exhibit good oxidation stability and high Noack volatility.

Preferably, the lubricant base oil fractions of the present invention have an aniline point greater than 36×ln(Kinematic Viscosity of the lubricant base oil fraction at 100° C.)+200. Accordingly, the lubricant base oil fractions according to the present invention exhibit good elastomer compatibility.

The lubricant base oil fractions of the present invention used as diluent oils in the oil soluble additive concentrates and finished lubricants contain greater than 95 weight % saturates as determined by elution column chromatography, ASTM D 2549-02. Olefins are present in an amount less than detectable by long duration $C^{13}$ Nuclear Magnetic Resonance Spectroscopy (NMR). Preferably, molecules with aromatic functionality are present in amounts less than 0.3 weight percent by HPLC-UV, and confirmed by ASTM D 5292-99 modified to measure low level aromatics. In preferred embodiments molecules with at least aromatic functionality are present in amounts less than 0.10 weight percent, preferably less than 0.05 weight percent, more preferably less than 0.01 weight percent. Sulfur is present in amounts less than 25 ppm, preferably less than 5 ppm, and more preferably less than 1 ppm as determined by ultraviolet fluorescence by ASTM D 5453-00.

The lubricant base oil fraction derived from highly paraffinic wax readily solubilizes lubricant additives and provides an oil additive concentrate that is readily soluble in the lubricant base oil stocks. In addition, the lubricant base oil fraction do not introduce any undesirable characteristics, including, for example, high volatility, high viscosity, and impurities such as heteroatoms, to the lubricant base oil stocks and thus, ultimately to the finished lubricant.

In a preferred embodiment, the lubricant base oil fraction according to the present invention is a Fischer-Tropsch derived lubricant base oil fraction. Fischer-Tropsch derived waxes are particularly well suited for providing Fischer-Tropsch derived lubricant base oil fractions with the above-described properties.

Aromatics Measurement by HPLC-UV:

The method used to measure low levels of molecules with aromatic functionality in the lubricant base oils uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricant base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with cycloparaffinic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and cycloparaffinic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified.

Quantification of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-cycloalkyl-1-ring aromatics and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-cycloalkyl-1-ring aromatics in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of molecules with aromatic functionality in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffinic function is very low in an oil, the additive solubility is low and the elastomer compatibility is poor. Examples of oils with these properties are Fischer-Tropsch oils (GTL oils) with less than about 5% cycloparaffins. To improve these properties in finished products, expensive co-solvents such as esters must often be added. Preferably, the oil fractions, derived from highly paraffinic wax and used as dielectric fluids, comprise a high weight percent of molecules with monocycloparaffinic functionality and a low weight percent of molecules with multicycloparaffinic functionality such that the oil fractions have high oxidation stability, low volatility, good miscibility with other oils, good additive solubility, and good elastomer compatibility.

The lubricant base oils of this invention were characterized by FIMS into alkanes and molecules with different numbers of unsaturations. The distribution of molecules in the oil fractions was determined by field ionization mass spectroscopy (FIMS). FIMS spectra were obtained on a Micromass VG 70VSE mass spectrometer. The samples were introduced via a solid probe into the spectrophotometer, preferably by placing a small amount (about 0.1 mg) of the base oil to be tested in a glass capillary tube. The capillary tube was placed at the tip of a solids probe for a mass spectrometer, and the probe was heated from about 40° C. up to 500° C. at a rate of 50° C. per minute, operating under vacuum at approximately $10^{-6}$ Torr. The mass spectrometer was scanned from m/z 40 to m/z 1000 at a rate of 5 seconds per decade. The acquired mass spectra were summed to generate one "averaged" spectrum. Each spectrum was $^{13}C$ corrected using a software package from PC-MassSpec.

Response factors for all compound types were assumed to be 1.0, such that weight percent was determined from area percent. The acquired mass spectra were summed to generate one "averaged" spectrum. The output from the FIMS analysis is the average weight percents of alkanes, 1-unsaturations, 2-unsaturations, 3-unsaturations, 4-unsaturations, 5-unsaturations, and 6-unsaturations in the test sample.

The molecules with different numbers of unsaturations may be comprised of cycloparaffins, olefins, and aromatics. If aromatics were present in significant amounts in the lubricant base oil they would most likely be identified in the FIMS analysis as 4-unsaturations. When olefins were present in significant amounts in the lubricant base oil they would most likely be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the weight percent of olefins by proton NMR, and minus the weight percent of aromatics by HPLC-UV is the total weight percent of molecules with cycloparaffin functionality in the lubricant base oils of this invention. The total of the 2-unsaturations, 3-unsaturations, 4-unsaturations, 5-unsaturations, and 6-unsaturations from the FIMS analysis, minus the weight percent of aromatics by HPLC-UV is the weight percent of molecules with multicycloparaffinic functionality in the oils of this invention. Note that if the aromatics content was not measured, it was assumed to be less than 0.1 wt % and not included in the calculation for total weight percent of molecules with cycloparaffin functionality.

In one embodiment, the lubricant base oil fractions derived from highly paraffinic wax have a weight percent of molecules with cycloparaffinic functionality greater than 3, preferably greater than 5. Preferably, the lubricant base oil fractions derived from highly paraffinic wax also have a ratio of weight percent of molecules with monocycloparaffinic functionality to weight percent of molecules with multicycloparaffinic functionality greater than 5, preferably greater than 15, more preferably greater than 50. In a preferred embodiment, the lubricant base oil fraction comprises greater than 9 alkyl branches/100 carbons.

In another embodiment of the lubricant base oil fractions derived from highly paraffinic wax, there is a relationship between the weight percent of all molecules with at least one cycloparaffinic functionality and the kinematic viscosity of the lubricant base oils of this invention. That is, the higher the kinematic viscosity at 100° C. in cSt, the higher the amount of molecules with cycloparaffinic functionality that are obtained. In a preferred embodiment, the lubricant base oil fractions derived from highly paraffinic wax have a weight percent of molecules with cycloparaffinic functionality greater than the kinematic viscosity in cSt multiplied by three. The lubricant base oil fractions derived from highly paraffinic wax have a kinematic viscosity at 100° C. between about 1.0 cSt and about 3.5 cSt, preferably between about 2.0 cSt and about 3.5 cSt, and more preferably between about 2.0 cSt and about 3.0 cSt.

The modified ASTM D 5292-99 and HPLC-UV test methods used to measure low level aromatics, and the FIMS test method used to characterize saturates are described in D. C. Kramer, et al., "Influence of Group II & III Base Oil Composition on VI and Oxidation Stability," presented at the 1999

AICHE Spring National Meeting in Houston, Mar. 16, 1999, the contents of which is incorporated herein in its entirety.

Although the highly paraffinic wax feeds are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed during the process of this invention by hydrofinishing or by clay treatment.

The properties of exemplary Fischer-Tropsch lubricant base oils suitable for use as lubricant additive diluent oils in oil soluble additive concentrates are summarized in Table II in the Examples.

Lubricant Additives

Finished lubricants comprise at least one lubricant base oil and at least one additive. Typically, the at least one additive is added to the lubricant base oil in the form of an oil soluble additive concentrate comprising at least one additive and a lubricant additive diluent oil, to improve the additive's solubility in the lubricant base oil. The intended use for the finished lubricant will influence the additives required to provide a suitable finished lubricant.

The lubricant additive diluent oils of the present invention may be used with any additive or additive package suitable for use in lubricant base oils to provide finished lubricants.

The additives for use in lubricant base oils to provide finished lubricants include additives selected from the group consisting of viscosity index improvers, detergents, dispersants, anti-wear additives, EP agents, antioxidants, pour point depressants, viscosity index improvers, viscosity modifiers, friction modifiers, demulsifiers, antifoaming agents, colorants, color stabilizers, corrosion inhibitors, rust inhibitors, seal swell agents, metal deactivators, biocides, and mixtures thereof.

The viscosity index improvers can be selected from the group consisting of olefin copolymers, co-polymers of ethylene and propylene, polyalkylacrylates, polyalkylmethacrylates, polyisobutylene, hydrogenated styrene-isoprene copolymers, hydrogenated styrene-butadienes, and mixtures thereof.

The additives may be in the form of a lubricant additive package, which comprises several additives to provide a finished lubricant with desirable properties. Lubricant additive packages for use in lubricant base oils to provide finished lubricants include lubricant additive packages selected from the group consisting of a detergent-inhibitor (DI) package, an engine oil additive package, an automatic transmission fluid additive package, a heavy duty transmission fluid additive package, a power steering fluid additive package, a gear oil additive package, and an industrial oil additive package.

According to the present invention, the lubricant base oil fraction derived from highly paraffinic wax may be used with an engine oil additive package designed for ILSAC GF-4 or API PC-10 engine oils.

Two of the more commonly used categories of additives in finished lubricants are DI packages and VI improvers. DI packages serve to suspend oil contaminants and combustion by-products, as well as to prevent oxidation of the finished lubricant with the resultant formation of varnish and sludge deposits. VI improvers modify the viscometric characteristics of lubricants by reducing the rate of thinning with increasing temperature and the rate of thickening with low temperatures. VI improvers thereby provide enhanced performance at low and high temperatures. In many applications, VI improvers are used with DI packages to provide a finished lubricant.

Oil Soluble Additive Concentrate

The lubricant additive diluent oils of the present invention are blended with one or more additives to provide an oil soluble additive concentrate to be added to lubricant base oil stocks to provide a finished lubricant. The oil soluble additive concentrates according to the present invention comprise the lubricant base oil fraction derived from highly paraffinic wax, as described herein, and one or more additives. The oil soluble additive concentrates according to the present invention may further comprise a conventional Group I base oil, a conventional Group II base oil, or a mixture thereof. When used as a further component in the oil soluble additive concentrates according to the present invention, preferably the conventional Group I base oil or conventional Group II base oil is selected from the group consisting of 100 N, 150 N, 220 N, and mixtures thereof.

The oil soluble additive concentrates according to the present invention are not suitable as finished lubricants on their own, but are blended with lubricant base oil stocks to provide a finished lubricant. The additives are readily soluble in the lubricant base oil fraction derived from highly paraffinic wax of the present invention, and the resulting oil soluble additive concentrates are readily soluble in lubricant base oil stocks to provide finished lubricants.

Advantageously, the oil soluble additive concentrates according to the present invention do not introduce any undesirable characteristics, including, for example, high volatility, high viscosity, high turbidity, or impurities such as heteroatoms, to the lubricant base oil stocks. The oil soluble additive concentrates according to the present invention have a low amount of heteroatom containing compounds including nitrogen and sulfur containing compounds and exhibit excellent solubility in the lubricant base oil stocks. In addition, the oil soluble additive concentrates according to the present invention exhibit good elastomer compatibility, low volatility, high oxidation stability, good low temperature properties, and low viscosity.

The oil soluble additive concentrate may be made by blending the lubricant base oil fraction derived from highly paraffinic wax and the one or more lubricant additives by techniques known to those of skill in the art. The oil soluble additive concentrate components may be blended in a single step going from the individual components (i.e., a Fischer-Tropsch derived lubricant base oil fraction, a DI package and a VI improver) directly to provide the oil soluble concentrate. In the alternative, the lubricant base oil fraction derived from highly paraffinic wax and one additive (i.e., the DI package) may be blended initially and then the resulting blend may be mixed with a second additive (i.e., the VI improver). The blend of the lubricant base oil fraction derived from highly paraffinic wax and the first additive may be isolated as such or the addition of the second additive may occur immediately.

The oil soluble additive concentrates preferably comprise 5 to 98 weight percent of the lubricant base oil fraction derived from highly paraffinic wax and at least 2 weight percent of one or more lubricant additives. More preferably, the oil soluble additive concentrates comprise 95 to 5 weight percent of the lubricant base oil fraction derived from highly paraffinic wax and 5 to 95 weight percent of one or more lubricant additives. The oil soluble additive concentrate will comprise varying amounts of the lubricant base oil fraction, used as a lubricant additive diluent oil, depending on the additive. By way of example, oil soluble additive concentrates with DI packages may contain about 50 weight % lubricant base oil fraction derived from highly paraffinic wax. Oil soluble additive concentrates with VI improver preferably comprises 2 to 20 weight % VI improver and 98 to 80 weight % lubricant base oil fraction derived from highly paraffinic wax. Oil soluble additive concentrates with gear oil additive packages may contain 25 weight % or less lubricant base oil fraction derived from highly paraffinic wax.

Finished Lubricant

To provide finished lubricants, the oil soluble additive concentrates of the present invention are blended with one or more lubricant base oil stocks. In addition to the one or more lubricant base oil stocks, the oil soluble additive concentrates of the present invention optionally may also be blended with additional additives, other additive concentrates, or combinations thereof to provide finished lubricants. Accordingly, the finished lubricants comprise the oil soluble additive concentrates of the present invention and one or more lubricant base oil stocks. Optionally, the finished lubricants may also comprise additional additives, other additive concentrates, or combinations thereof.

The finished lubricant preferably comprises 0.5 to 50 weight percent of the oil soluble additive concentrates of the present invention and 30 to 99.5 weight percent of the one or more lubricant base oils, preferably 0.5 to 50 weight percent of the oil soluble additive concentrates of the present invention and 50 to 99.5 weight percent of the one or more lubricant base oils. The lubricant base oils can be any oils suitable for use as a lubricant base oil for the intended purpose of the finished lubricant. The lubricant base oils can be lubricant base oils selected from the group consisting of conventional Group I base oils, conventional Group II base oils, conventional Group III base oils, Fischer-Tropsch derived base oils, Group IV base oils, poly internal olefins, diesters, polyol esters, phosphate esters, alkylated aromatics (i.e., alkylated naphthalenes), alkylated cycloparaffins, vegetable oils, and mixtures thereof. The lubricant base oil stocks and the additives will be selected based on the intended use for the finished lubricant.

In certain embodiments, the finished lubricant according to the present invention meets the specifications for an SAE J300 multigrade engine oil. The finished lubricant according to the present invention may also meet specifications selected from the group consisting of ILSAC GF-3, ILSAC GF-4, API CI-4, API PC-10, and combinations thereof. Preferably, the finished lubricant according to the present invention comprises less than 0.7 weight % total sulfur as measured by ASTM D 1552 and more preferably less than 0.5 weight % total sulfur as measured by ASTM D 1552.

The finished lubricants may be made by blending the oil soluble additive concentrates according to the present invention with one or more lubricant base oil stocks and optionally additional additives, other additive concentrates, or combinations thereof by techniques known to those of skill in the art. The finished lubricants may be blended in a single step going from the individual components (i.e., the oil soluble additive concentrate and the one or more lubricant base oil stocks) directly to provide the finished lubricant. In the alternative, the oil soluble additive concentrate and one lubricant base oil stock may be blended initially to provide a lubricant blend and then the lubricant blend may be mixed with one or more additional lubricant base oil stocks and optionally additional additives, other additive concentrates, or combinations thereof. The lubricant blend may be isolated as such or the addition of the additional lubricant base oil stocks, additional additives, or other additive concentrates may occur immediately.

The lubricant base oil fraction derived from highly paraffinic wax used as a lubricant additive diluent oil may be manufactured at a site different from the site at which the components of the oil soluble concentrate are received and blended. In addition, the finished lubricant may be manufactured at a site different from the site at which the components of the oil soluble concentrate are received and blended.

In a preferred embodiment the lubricant base oil fraction is derived from a Fischer Tropsch process, and the oil soluble concentrate and the finished lubricant are made at the same site, which site is different from the site at which the Fischer-Tropsch derived lubricant base oil fraction is originally made. Furthermore, the components of the finished lubricant (i.e., the Fischer-Tropsch derived lubricant base oil fraction, the lubricant base oil stocks, and the additives) may all be manufactured at different sites. Preferably, the Fischer-Tropsch derived lubricant base oil fraction is manufactured at a remote site (i.e., a location away from a refinery or market, which location may have a higher cost of construction than the cost of construction at the refinery or market. In quantitative terms, the distance of transportation between the remote site and the refinery or market is at least 100 miles, preferably more than 500 miles, and most preferably more than 1000 miles).

Preferably, the Fischer-Tropsch derived lubricant base oil is manufactured at a first remote site and shipped to a second site. The lubricant base oil stocks to be included in the finished lubricant may be manufactured at a site that is the same as the first remote site or at a third remote site. The second site receives the Fischer-Tropsch derived lubricant base oil fraction, the lubricant base oil stocks, and the additives. The oil soluble concentrate and the finished lubricant are manufactured at this second site.

Other Uses

In addition to use as lubricant additive diluent oils, the extra light hydrocarbon liquids of the present invention may also be used as mineral seal oil, rolling mill oil, agricultural spray oil, drilling fluid, high flash cleaning solvent, spindle oil, diluent for ink, dielectric fluid, and food grade applications.

Drilling Fluid: Any of a number of liquid and gaseous fluids and mixtures of fluids and solids (as solid suspensions, mixtures and emulsions of liquids, gases and solids) used in operations to drill boreholes into the earth. Classifications of drilling fluids has been attempted in many ways, often producing more confusion than insight. One classification scheme, given here, is based only on the mud composition by singling out the component that clearly defines the function and performance of the fluid: (1) water-base, (2) non-water-base and (3) gaseous (pneumatic). Each category has a variety of subcategories that overlap each other considerably. fluids used in hydrocarbon drilling operations, especially fluids that contain significant amounts of suspended solids, emulsified water or oil. Mud includes all types of water-base, oil-base and synthetic-base drilling fluids. Drill-in, completion and workover fluids are sometimes called muds, although a fluid that is essentially free of solids is not strictly considered mud.

Rolling Mill Oil: A lubricant used in a machine for rolling metal into sheets, bars, or other forms. Typical metals that are rolled include steel and aluminum. The lubricant must provide a low friction coefficient, an acceptable bearing capacity, and produce a smooth product surface.

Mineral Seal Oil: A general term for a light lubricant having the following properties: low viscosity, light color, low odor, high aniline point, low pour point, good color stability, and low volatility.

Agricultural Spray Oil: A light viscosity oil sprayed on growing crops or harvested agricultural products to improve product quality and yields. They are used to reduce insect damage, control fungus and other diseases, reduce dust, and reduce evapo-transpiration. The oils must have low phytotoxicity and volatility, as well as be odorless, non-toxic, and biodegradable.

Spindle Oil: A light viscosity oil used in high speed lightly loaded bearings, such as those found in textile spinning frames and automated machine tools. These low viscosity oils lower operating temperatures and increases machine efficiency. They are typically formulated with additives, including anti-oxidants, rust inhibitors, and antiwear agents. Desired properties of a spindle oil are high oxidation stability, low volatility, low staining, low pour point, and high viscosity index.

Dielectric Fluid: Dielectric fluids are fluids that can sustain a steady electric field and act as an electrical insulator. Accordingly, dielectric fluids serve to dissipate heat generated by energizing components and to insulate those components from the equipment enclosure and from other internal parts and devices.

EXAMPLES

The invention will be further explained by the following illustrative examples that are intended to be non-limiting.

Example 1

Fischer-Tropsch Wax and Preparation of Fischer-Tropsch Lubricant Base Oils

A sample of commercial hydrotreated Fischer-Tropsch wax made using a Fe-based Fischer-Tropsch synthesis catalyst and a sample of hydrotreated Fischer-Tropsch wax made using a Co-based Fischer-Tropsch catalyst were analyzed and found to have the properties shown in Table I.

TABLE I

| | Fischer-Tropsch Catalyst | |
|---|---|---|
| | Fe-Based | Co-Based |
| Sulfur, ppm | | <6 |
| Nitrogen, ppm | | 6.5* |
| Oxygen by NA, Wt % | | 0.59 |
| GC N-Paraffin Analysis | | |
| Total N Paraffin, Wt % | | 84.47 |
| Avg. Carbon Number | | 27.3 |
| Avg. Molecular Weight | | 384.9 |
| D 6352 Sim. Dist. (Wt %), ° F. | | |
| 0.5 | 10 | 515 |
| 5 | 131 | 597 |
| 10 | 181 | 639 |
| 20 | 251 | 689 |
| 30 | 309 | 714 |
| 40 | 377 | 751 |
| 50 | 437 | 774 |
| 60 | 497 | 807 |
| 70 | 553 | 839 |
| 80 | 611 | 870 |
| 90 | 674 | 911 |
| 95 | 707 | 935 |
| 99.5 | 744 | 978 |

*duplicate tests

The Fischer-Tropsch wax feeds were hydroisomerized over a Pt/SAPO-11 catalyst on an alumina binder. Run conditions were a temperature of between 652 and 695° F. (344 and 368° C.), liquid hourly space velocity (LHSV) of 0.6 to 1.0 $hr^{-1}$, 1000 psig reactor pressure, and a once-through hydrogen rate of between 6 and 7 MSCF/bbl. The reactor effluent passed directly to a second reactor, also at 1000 psig, which contained a Pt/Pd on silica-alumina hydrofinishing catalyst. Conditions in that reactor were a temperature of between 425 and 700° F. (218 and 372° C.), and LHSV of 1.0 $hr^{-1}$.

The products boiling above about 600° F. were fractionated by atmospheric or vacuum distillation to produce five fractions having viscosities between about 2.0 and 3.5 cSt at 100° C. The properties of the five fractions are shown in Table II.

TABLE II

| Properties | Example 1 | Example 2 | Example 3 | Example 4 | Example 5 |
|---|---|---|---|---|---|
| Wax Feed | Fe-Based | Fe-Based | Co-Based | Co-Based | Co-Based |
| Hydroisomerization Temp. ° F. | 681 | 681 | 694 | 671 | 690 |
| Viscosity at 100° C., cSt | 2.981 | 2.598 | 2.583 | 2.297 | 3.189 |
| VI | 127 | 124 | 133 | 124 | 122 |
| Aromatics, Wt % | 0.0128 | 0.0107 | | | |
| FIMS, Wt % of Molecules | | | | | |
| Paraffins | 89.2 | 91.1 | 93.0 | 91.3 | 81.3 |
| Monocycloparaffins | 10.8 | 8.9 | 7.0 | 8.0 | 18.7 |
| Multicycloparaffins | 0.0 | 0.0 | 0.0 | 0.7 | 0.0 |
| Total | 100.0 | 100.0 | 100.0 | 100.0 | 100.0 |
| API Gravity | 43.4 | 44.1 | 43.85 | 44.69 | |
| Pour Point, ° C. | −27 | −32 | −30 | −33 | 5 |
| Cloud Point, ° C. | −18 | −22 | −16 | −7 | 12 |
| Mono/Multicycloparaffins | >100 | >100 | >100 | 11.4 | >100 |
| Oxidator BN, Hours | | | 40.14 | | |
| Aniline Point, D 611-04, ° F. | 236.5 | 226.3 | | | |
| Noack Volatility, Wt % | 32.48 | 49.18 | 48.94 | | 21.8 |
| 160-40(Viscosity at 100° C.) | 40.76 | 56.08 | 56.68 | 68.12 | 32.44 |
| D 6352 Sim. Dist. (Wt %), ° F. | | | | | |
| 0.5 | 652 | 597 | 601 | 591 | 672 |
| 5 | 670 | 615 | 618 | 605 | 695 |

TABLE II-continued

| Properties | Example 1 | Example 2 | Example 3 | Example 4 | Example 5 |
|---|---|---|---|---|---|
| 10 | 681 | 626 | 630 | 616 | 707 |
| 20 | 697 | 646 | 653 | 634 | 722 |
| 30 | 713 | 666 | 673 | 652 | 734 |
| 40 | 728 | 686 | 693 | 668 | 744 |
| 50 | 744 | 706 | 713 | 684 | 755 |
| 60 | 760 | 726 | 733 | 699 | 767 |
| 70 | 776 | 748 | 754 | 715 | 779 |
| 80 | 792 | 769 | 777 | 732 | 793 |
| 90 | 808 | 791 | 802 | 750 | 810 |
| 95 | 817 | 803 | 816 | 767 | 823 |
| 95.5 | 833 | 825 | 833 | 800 | 850 |
| NMR, Alkyl Branches/100 Carbons | 10.05 | 10.36 | Not tested | 9.46 | 9.20 |

Example 2

Preparation of Oil Soluble Additive Concentrates

The above-example five Fischer-Tropsch derived lubricant base oil fractions can be used as lubricant additive diluent oils and blended with additives to provide an oil soluble additive concentrate.

As such, 98 to 80 weight percent Fischer-Tropsch derived lubricant base oil fraction is blended with 20 to 2 weight percent olefin copolymer VI improver to provide oil soluble additive concentrates. By way of example, Example 3 Fischer-Tropsch derived lubricant base oil fraction was blended with approximately 6 weight percent olefin copolymer VI improver. There was no evidence of polymer coming out of solution or of any other gross insolubility.

Example 3

Comparative Example

The properties of four commercially available conventional petroleum-derived oils (Pennzoil 75HC, Petro Canada VHVI2, Nexbase 3020, and Ergon Hygold 60) and a commercially available polyalphaolefin (Chevron Synfluid 2) having viscosities below 3.0 cSt at 100° C. are shown in Table III.

TABLE III

| | Pennzoil 75HC | Petro Canada VHVI2 | Nexbase 3020 | Ergon Hygold 60 | Chevron Synfluid 2 |
|---|---|---|---|---|---|
| Viscosity at 100° C., cSt | 2.885 | 2.434 | 2.055 | 2.265 | 1.726 |
| VI | 80 | 103 | 96 | 36 | 146 |
| Pour Point, ° C. | −38 | −42 | −51 | −61 | Not tested |
| Noack Volatility, Wt % | 59.1 | 69.5 | 70 | 98.5 | 99.9 |

The above-exemplified conventional petroleum-derived oils and polyalphaolefin having viscosities between 2.0 and 3.5 cSt at 100° C. all have Noack volatilities greater than 50 weight percent, and more specifically greater than 59 weight percent. In comparison, the Noack volatilities of the Fischer-Tropsch lubricant base oil fractions of Examples 1-5 were all significantly less than 50 weight percent. Accordingly, the Fischer-Tropsch lubricant base oil fractions of the present invention have low volatility and low viscosity.

While the present invention has been described with reference to specific embodiments, this application is intended to cover those various changes and substitutions that may be made by those of ordinary skill in the art without departing from the spirit and scope of the appended claims.

What is claimed is:

1. A process for producing an oil soluble additive concentrate comprising:

a. providing a lubricant base oil fraction having a viscosity of between about 1.0 and 3.5 cSt at 100° C. and a Noack volatility of less than a Noack Volatility Factor as calculated by the following equation:

$$\text{Noack Volatility Factor}=160-40(\text{Kinematic Viscosity at } 100^\circ\text{ C.}),$$

wherein the lubricant base oil fraction comprises greater than 3 weight % molecules with cycloparaffinic functionality and less than 0.30 weight percent aromatics;

b. blending the lubricant base oil fraction with at least 2 weight % of one or more lubricant additives; and c. isolating an oil soluble additive concentrate.

2. The process of claim 1, wherein the lubricant base oil fraction is derived from a Fischer-Tropsch process.

3. The process of claim 1, wherein the lubricant base oil fraction comprises greater than 5 weight % molecules with cycloparaffinic functionality.

4. The process of claim 1, wherein the lubricant base oil fraction comprises a ratio of weight % of molecules with monocycloparaffinic functionality to weight % of molecules with multicycloparaffinic functionality of greater than 5.

5. The process of claim 1, wherein the lubricant base oil fraction comprises greater than 9 alkyl branches/100 carbons.

6. The process of claim 1, further comprising blending the lubricant base oil fraction with a conventional Group I base oil or a conventional Group II base oil.

7. The process of claim 6, wherein the conventional Group I base oil or conventional Group II base oil is selected from the group consisting of 100 N, 150 N, 220 N, and mixtures thereof.

8. The process of claim 1, wherein the one or more lubricant additives are selected from the group consisting of viscosity index improvers, detergents, dispersants, anti-wear additives, EP agents, antioxidants, pour point depressants, viscosity index improvers, viscosity modifiers, friction modifiers, demulsifiers, antifoaming agents, colorants, color stabilizers, corrosion inhibitors, rust inhibitors, seal swell agents, metal deactivators, biocides, and mixtures thereof.

9. The process of claim 1, wherein the one or more lubricant additives comprise a lubricant additive package.

10. The process of claim 9, wherein the lubricant additive package is selected from the group consisting of a detergent-inhibitor package, an engine oil additive package, an automatic transmission fluid additive package, a heavy duty transmission fluid additive package, a power steering fluid additive package, a gear oil additive package, and an industrial oil additive package.

11. A process for producing an oil soluble additive concentrate comprising:

a. performing a Fischer-Tropsch synthesis to provide a product stream;

b. isolating from the product stream a substantially paraffinic wax feed;

c. hydroisomerizing the substantially paraffinic waxy feed using a shape selective intermediate pore size molecular sieve comprising a noble metal hydrogenation component under conditions of about 600° F. to about 750° F.;

d. isolating an isomerized oil;

e. hydrofinishing the isomerized oil to provide a Fischer-Tropsch derived lubricant base oil fraction having a viscosity of between about 1.0 and 3.5 cSt at 100° C. and a Noack volatility of less than a Noack Volatility Factor as calculated by the following equation: Noack Volatility Factor=160−40(Kinematic Viscosity at 100° C.), wherein the Fischer-Tropsch derived lubricant base oil fraction comprises greater than 3 weight % molecules with cycloparaffinic functionality and less than 0.30 weight percent aromatics;

f. blending the Fischer-Tropsch derived lubricant base oil fraction with at least 2 weight % of one or more lubricant additives; and g. isolating an oil soluble additive concentrate.

12. The process of claim 11, further comprising distilling the isomerized oil to provide the Fischer-Tropsch derived lubricant base oil fraction.

13. The process of claim 11, wherein the noble metal hydrogenation component is platinum, palladium, or combinations thereof.

14. The process of claim 11, wherein the shape selective intermediate pore size molecular sieve is selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof.

15. The process of claim 11, wherein the Fischer-Tropsch derived lubricant base oil fraction comprises greater than 5 weight % molecules with cycloparaffinic functionality.

16. The process of claim 11, wherein the Fischer-Tropsch derived lubricant base oil fraction comprises a ratio of weight % of molecules with monocycloparaffinic functionality to weight % of molecules with multicycloparaffinic functionality of greater than 5.

17. The process of claim 11, further comprising blending the Fischer-Tropsch derived lubricant base oil fraction with a conventional Group I base oil or a conventional Group II base oil.

18. The process of claim 17, wherein the conventional Group I base oil or conventional Group II base oil is selected from the group consisting of 100 N, 150 N, 220 N, and mixtures thereof.

19. The process of claim 11, wherein the one or more lubricant additives are selected from the group consisting of viscosity index improvers, detergents, dispersants, anti-wear additives, EP agents, antioxidants, pour point depressants, viscosity index improvers, viscosity modifiers, friction modifiers, demulsifiers, antifoaming agents, colorants, color stabilizers, corrosion inhibitors, rust inhibitors, seal swell agents, metal deactivators, biocides, and mixtures thereof.

20. The process of claim 11, wherein the one or more lubricant additives comprise a lubricant additive package.

21. The process of claim 20, wherein the lubricant additive package is selected from the group consisting of a detergent-inhibitor package, an engine oil additive package, an automatic transmission fluid additive package, a heavy duty transmission fluid additive package, a power steering fluid additive package, a gear oil additive package, and an industrial oil additive package.

22. A process for producing a finished lubricant comprising:

a. providing a lubricant base oil fraction having a viscosity of between about 1.0 and 3.5 cSt at 100° C. and a Noack volatility of less than a Noack Volatility Factor as calculated by the following equation: Noack Volatility Factor=160−40(Kinematic Viscosity at 100° C.), wherein the lubricant base oil fraction comprises greater than 3 weight % molecules with cycloparaffinic functionality and less than 0.30 weight percent aromatics;

b. blending the lubricant base oil fraction with one or more lubricant additives to provide an oil soluble additive concentrate comprising at least 2 weight % of the one or more lubricant additives; and c. blending the oil soluble additive concentrate with one or more lubricant base oils.

23. The process for producing a finished lubricant of claim 22, wherein the finished lubricant comprises 0.5 to 50 weight % oil soluble additive concentrate and 30 to 99.5 weight % one or more lubricant base oils.

24. The process for producing a finished lubricant of claim 22, wherein the lubricant base oil fraction is derived from a Fischer-Tropsch process.

25. The process for producing a finished lubricant of claim 22, wherein the lubricant base oil fraction comprises greater than 5 weight % molecules with cycloparaffinic functionality.

26. The process for producing a finished lubricant of claim 22, wherein the lubricant base oil fraction comprises a ratio of weight % of molecules with monocycloparaffinic functionality to weight % of molecules with multicycloparaffinic functionality of greater than 15.

27. The process for producing a finished lubricant of claim 22, wherein the one or more lubricant additives are selected from the group consisting of viscosity index improvers, detergents, dispersants, anti-wear additives, EP agents, antioxidants, pour point depressants, viscosity index improvers, viscosity modifiers, friction modifiers, demulsifiers, antifoaming agents, colorants, color stabilizers, corrosion inhibitors, rust inhibitors, seal swell agents, metal deactivators, biocides, and mixtures thereof.

28. The process for producing a finished lubricant of claim 22, wherein the one or more lubricant additives comprise a lubricant additive package.

29. The process for producing a finished lubricant of claim 28, wherein the lubricant additive package is selected from the group consisting of a detergent-inhibitor package, an engine oil additive package, an automatic transmission fluid additive package, a heavy duty transmission fluid additive package, a power steering fluid additive package, a gear oil additive package, and an industrial oil additive package.

30. The process for producing a finished lubricant of claim 22, wherein the one or more lubricant base oils are selected from the group consisting of conventional Group I base oils, conventional Group II base oils, conventional Group III base oils, Fischer-Tropsch derived base oils, Group IV base oils, poly internal olefins, diesters, polyol esters, phosphate esters, alkylated aromatics, alkylated cycloparaffins, alkylated naphthalenes, vegetable oils, and mixtures thereof.

31. The process for producing a finished lubricant of claim 22, wherein the finished lubricant meets the specifications for an SAE J300 multigrade engine oil.

32. The process for producing a finished lubricant of claim 31, wherein the finished lubricant further meets specifications selected from the group consisting of ILSAC GF-3, ILSAC GF-4, API CI-4, API PC-10, and combinations thereof.

* * * * *